US005200932A

United States Patent [19]

Ljung

[11] Patent Number: 5,200,932

[45] Date of Patent: Apr. 6, 1993

[54] UNDERWATER AUDIBLE SIGNALLING DEVICE

[76] Inventor: Bo H. G. Ljung, 32 Hemlock Ter., Wayne, N.J. 07470

[21] Appl. No.: 822,095

[22] Filed: Jan. 17, 1992

[51] Int. Cl.[5] ..... H04R 15/00

[52] U.S. Cl. ..... 367/174; 367/171; 367/910; 181/142; 116/142 FP

[58] Field of Search ..... 116/142 FP, 137 R; 181/142, 151, 166, 171, 198, 402; 367/142, 171, 172, 174, 176, 910; 446/184, 185, 193, 207; 381/158

[56] References Cited

U.S. PATENT DOCUMENTS

| | | | |
|---|---|---|---|
| 259,782 | 6/1882 | Toppel | 181/142 |
| 929,623 | 7/1909 | Nirenberg | 181/142 |
| 1,080,098 | 12/1913 | Blake | 181/142 |
| 1,627,467 | 5/1927 | Sparlin | 116/142 FP |
| 2,496,060 | 1/1950 | Mell et al. | 181/0.5 |
| 2,897,491 | 7/1959 | Young, Jr. | 367/176 |
| 3,125,061 | 3/1964 | Liebermann et al. | 116/137 R |
| 4,095,667 | 6/1978 | Mahig et al. | 181/120 |
| 4,123,622 | 10/1978 | Macleod | 181/149 X |
| 4,821,838 | 4/1989 | Chen | 181/175 |
| 4,852,510 | 8/1989 | Joseph, Jr. et al. | 116/137 R |
| 4,858,204 | 8/1989 | Holston et al. | 367/141 |
| 4,872,148 | 10/1989 | Kirby et al. | 367/172 |
| 4,893,580 | 1/1990 | Joseph, Jr. et al. | 116/137 R |
| 4,950,107 | 8/1990 | Hancock et al. | 116/26 X |
| 4,998,499 | 3/1991 | Nordbeck | 116/142 FP |
| 5,022,790 | 6/1991 | Stevenson | 116/142 FP X |

OTHER PUBLICATIONS

Bobber, Robert J., Underwater Electroacoustic Measurements, Naval Research Lab, Washington, D.C. Jul. 1970, pp. 280–282.

Wood, A. B., "A Textbook of Sound", G. Bell and Sons Ltd., 1960, pp. 231–236.

Richardson, E. G., "Technical Aspects of Sound", vol. II, Elsevier, 1957, pp. 222–224.

Albers, V. M., "Underwater Acoustics", Plenum Press, p. 5.

*Primary Examiner*—Brian S. Steinberger

[57] ABSTRACT

A signalling device with a long audible range is described, which is intended for underwater communication between divers. The device consists of a compact and lightweight horn and a rubber bulb. The horn, which works independently from a diver's supply of breathing air, is filled with water and operated by manually squeezing the rubber bulb.

7 Claims, 2 Drawing Sheets

UNDERWATER AUDIBLE SIGNALLING DEVICE

BACKGROUND OF THE INVENTION

1. Field of the Invention

This invention relates to an audible signalling device for underwater use and, more particularly, to a manually actuated horn for underwater signalling between divers.

2. Description of the Prior Art

Much attention has been given to various acoustic signalling devices for use in air and underwater. One such effort is described in U.S. Pat. No. 259,782, entitled "Fog horn", which describes an air driven horn for use above water. A manually operated pump is used to force air through a vibrating reed assembly, which is connected to a trumpet in order to amplify the sound. Sound from air driven horns either ceases or is reduced to a low intensity when submerged in water, even though air is supplied to power the horns. Also, the sound from an air horn is reduced to a low buzz when submerged and powered by a stream of water.

Another effort is described in U.S. Pat. No. 929,623, entitled "Device for transmitting sound waves", which details a fluid driven horn for shipboard use. A vibrating diaphragm is built into the hull of a ship such that it is in contact with water on one side and with air on the other side. A pump forces air or water through a stationary nozzle onto the diaphragm. Periodic movement of the diaphragm allows the fluid to pass through a small opening between the nozzle and the diaphragm, causing it to emit sound into the water. This device requires that the diaphragm is in contact with air on one side and will not work if it is totally submerged in a body of water. A similar effort is described in U.S. Pat. No. 1,080,098, entitled "Submarine signalling", which teaches underwater signalling devices built around a valve that exhibits a "water hammer" effect. In this invention, water is forced under pressure through a nozzle with an extended surface area in contact with a resiliently supported stop plate. Hydraulic forces on the latter causes the rapidly streaming water to turn on and off, causing large variations in static water pressure. Sound is coupled into a surrounding body of water by combining this valve with a sound-radiating body, such as a metal pipe. Both water-powered underwater signalling devices require a high pressure pump for their operation, and are therefore not easily usable in diving.

Another effort is described in U.S. Pat. No. 3,125,061, entitled "Underwater fluid operated horn", which discloses a horn, driven by compressed air, for use underwater. This horn uses a sound-emitting diaphragm coupled to water on one side, and to a very small cavity supplied with compressed air on the other. The compressed air periodically forces the diaphragm to deflect, opening and closing an air passage between the diaphragm and a stationary sealing ring. The motion of the diaphragm couples sound waves to the water. The expended air is directed to one side of the horn, where the bubbles have the effect of absorbing some of the sound from the diaphragm.

U.S. Pat. No. 4,095,667, entitled "Portable underwater signalling transducer", describes another signalling device, which consists of a pneumatically driven jackhammer that emits sound into a body of water as a result of the hammer striking a metal diaphragm.

Two very similar signalling devices are described in U.S. Pat. Nos. 4,852,510 and 4,893,580, both entitled "Scuba whistle", which consist of a pneumatically driven whistle, enclosed inside a resonant pipe. The whistle makes the pipe vibrate and the outside of the pipe, which is in contact with a body of water, transmits the sound.

A conventional air horn is described in U.S. Pat. No. 4,950,107, entitled "Audible alarm device for divers", for use by divers above water. Compressed air from a tank is forced through a conventional horn. This device does not work when submerged in water.

A similar air horn for divers is described in U.S. Pat. No. 4,998,499, entitled "Underwater pneumatic horn", which can be used by a diver both above and under water, after reconfiguration. The horn works in a conventional fashion above water. Compressed air from a tank is used to periodically deflect a diaphragm which is in fluid connection to a trumpet. The trumpet is furnished with a screw-on cover with a built-in check valve for underwater use. To use the horn underwater, the diver must attach the cover to the trumpet and purge the horn of water before it can be used. The range of the horn underwater is approximately 300 feet.

Another effort is described in U.S. Pat. No. 5,022,790, entitled "Audible signalling system for divers", which consists of a combination of two signalling devices for use by a diver above and under water. A conventional pneumatic horn is used to signal above water. For signalling underwater, compressed air is routed through an oscillatory valve mounted on a diver's air tank. Air passing through this valve causes the valve stem to vibrate, coupling sound to the surrounding water via the tank, which functions as a sounding board.

Most prior art signalling devices suitable for use underwater require compressed air for their operation. The compressed air is usually supplied from the diver's supply of breathing air, which may be in short supply. A recent study reveals that 40% of all diving accidents, and an even higher percent of fatalities, are caused by an out-of-air condition. Use of a compressed air driven signalling device during a dive consumes air which would otherwise be available to the diver for breathing. Also, the use of such a signalling device to alert a companion diver of an out-of-air situation may not be possible. It is therefore desirable to utilize an underwater signalling device that works independent of a diver's supply of breathing air.

U.S. Pat. No. 4,858,204, entitled "Underwater signalling device", describes a manually operated underwater signalling device. The main parts consist of a clapper which is held preloaded against a striking plate by means of a spring. The clapper, when lifted and released, hits the striking plate which is in acoustical contact with a diver's air tank. The air tank, which acts as a resonator, transmits the impact sound into the surrounding water, over a range of up to 50 feet. It is generally accepted that the direction of an underwater sound source can only be judged by finding out if the sound gets louder or quieter by moving closer or further away from the source. Short-duration impact sounds make this judgement difficult. Also, the signalling device must be mounted on an air tank which is carried on the diver's back. This makes it inconvenient for a diver to operate the device.

One objective of the present invention is to reveal a new class of manually operated underwater signalling devices that work independent of a diver's supply of breathing air.

Another objective is to provide water powered underwater signalling devices that will operate without adjustments at any depth.

A further objective of the present invention is to provide small, self-contained signalling devices that can produce signals of extended duration, which can be heard underwater over long distances.

A final objective of the present invention is to provide underwater signalling devices that can be used for transmission of simple predefined messages.

SUMMARY OF THE INVENTION

In accordance with the present invention, an improved underwater audible signalling device is provided, which is suitable for use by a diver in the course of a dive. The signalling device comprises a compact and lightweight sound projector and an elastic bulb. The device is manually operated by purging the device from air and squeezing the water-filled bulb.

DESCRIPTION OF THE ILLUSTRATED EMBODIMENT

Figure 1:
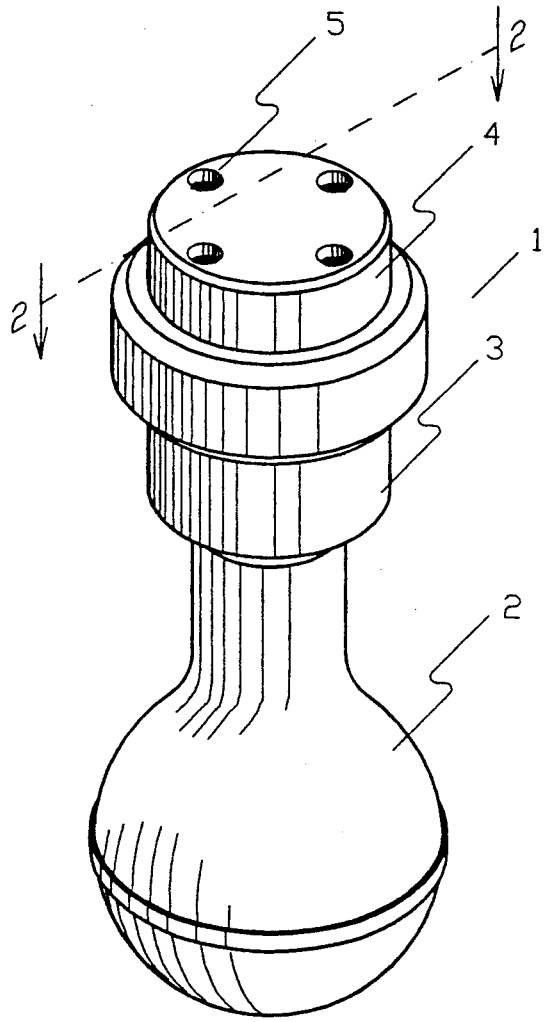
FIG. 1 is a perspective view of the preferred embodiment.

The present invention is an audible signalling device specifically designed to be used underwater for communication between divers. FIG. 1 shows a perspective view of the underwater audible signalling device, which comprises a sound projector 1 and an elastic bulb 2. The sound projector 1 comprises a housing 3 and a retaining cap 4 with holes 5. The holes 5 allow the interior of the audible signalling device to be in fluid communication with a surrounding body of water. To operate the audible signalling device, the elastic bulb 2 is squeezed to purge the device of air through the holes 5. Releasing the elastic bulb 2 causes the unit to be filled with water. By manually squeezing the elastic bulb 2, a stream of water is forced through the sound projector 1, which produces a prolonged horn like sound which can be heard over long distances underwater. The sound pressure field is omnidirectional.

Figure 2:
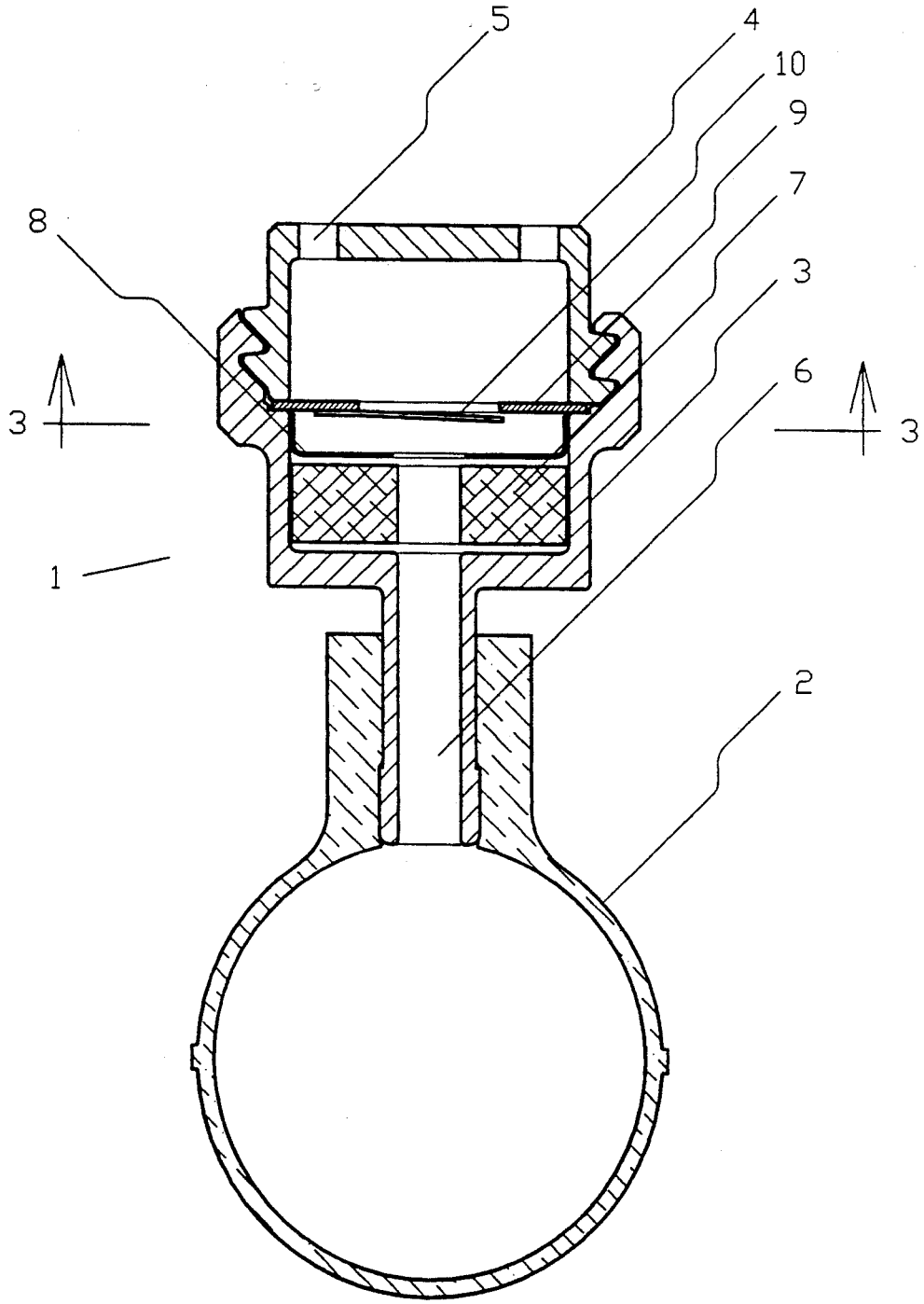
FIG. 2 is a longitudinal cross-sectional view of the embodiment in FIG. 1, taken along lines 2—2 in FIG. 1.

FIG. 2 shows a cross-sectional view of the structure shown in FIG. 1, taken in a longitudinal direction along line 2—2 in FIG. 1. In reference to FIG. 2, the elastic bulb 2 is connected to the housing 3 with a nipple 6. A cylindrically shaped compressible body 7, with a centrally located through-hole is placed in the interior of the housing 3. A spacer 8, also with a centrally located through-hole, holds the compressible body 7 in place. A diaphragm 9 is secured in a watertight fashion between the housing 3 and the retaining cap 4. A reed 10 is attached in one end to the diaphragm 9. The reed 10 is shaped in a slightly curved fashion such that its free end is spaced a small distance away from the diaphragm 9.

Figure 3:
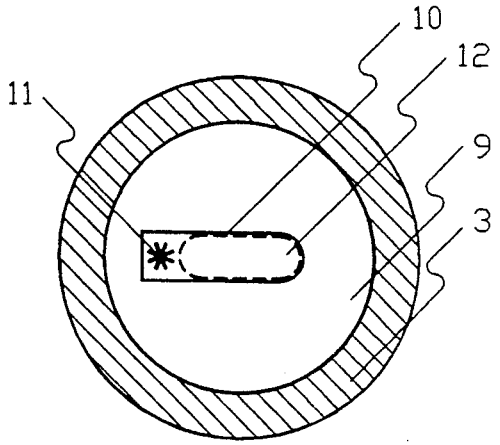
FIG. 3 is a cross-sectional view of the embodiment in FIG. 1, taken along lines 3—3 in FIG. 2.

FIG. 3 is a cross-sectional view of the structure shown in FIG. 1, taken along lines 3—3 in FIG. 2. The disk shaped diaphragm 9 has a centrally located oblong opening 12. The reed 10 is fastened in one end to the diaphragm 9 by means of a spot weld 11.

An efficient diaphragm-based sound projector requires that the sound waves from one side of the diaphragm are isolated from the waves originating from the other side in order to avoid destructive interference between the sound waves. This is accomplished in regular air horns operated above water by totally enclosing one side of the diaphragm. Before the advent of the present invention, this could not be accomplished in a water-filled sound projector operated by a stream of water in a surrounding body of water because of the incompressible nature of this medium, which couples the sound waves from the enclosed side of the diaphragm to the surrounding body of water. The unwanted coupling through the enclosure causes the sound waves from both sides of the diaphragm to cancel, resulting in a very low intensity sound.

As earlier noted, sound from an air horn is almost inaudible when submerged and powered by a stream of water. The result of applying water under pressure, is to either close or open the valve, depending on the particular design. The reason for this is that the incompressible nature of water prevents vibratory motion of the diaphragm or the reed.

Again, referring to FIG. 2, the present invention circumvents this problem and makes it possible to excite the diaphragm 9 in a large amplitude vibrational motion. This is accomplished by making the water contained in the housing 3 behave as a compressible fluid, by the use of a compressible body 7. The compressible body 7 is made from a material that decreases in volume when subjected to increasing hydraulic pressure and that increases in volume when the hydraulic pressure is decreased. The inclusion of the compressible body 7 has the effect of making the water contained in the housing 3 behave as if it is compressible. This allows the diaphragm 9 to vibrate without the great resistance to volume change normally associated with an incompressible fluid. This makes the valve or reed behave in a vibratory manner, causing high intensity sound to be projected into a surrounding body of water.

It has been found that certain types of closed-cell foam rubber are suitable for use as a compressible body 7. More specifically, it has been found that internally pressure foamed synthetic rubber, based on polymerized chloroprene with low durometer hardness and with closed gas-filled cells, is especially suitable.

In addition, the inventor has found that the coupling of the sound waves from the enclosed side of the diaphragm 9 through the housing 3 to the surrounding body of water can be eliminated by installation of the compressible body 7. The gas bubbles entrained in the material vibrate by changing their volume in response to sound vibrations in the liquid, preventing large pressure fluctuation inside housing 3. This causes the sound from the lower side of the diaphragm 9 to be contained within the housing 3. The upper side of the diaphragm 9 is thus free to radiate sound waves into the surrounding water without destructive interference from the sound waves radiated from the lower side of diaphragm 9.

A different method of reducing sound cancellation of vibrating diaphragms in hydrophones and underwater sound projectors is described by Robert J. Bobber in "Underwater Electroacoustic Measurements", July 1970, Naval Research Laboratory, Washington, D.C., page 280–282. This method was developed by C. C. Sims at the Navy Underwater Sound Reference Laboratory. A pressure gradient hydrophone is described where the diaphragm is mounted in the center of a hollow tungsten disk or cylinder. Although the diaphragm is coupled intimately to the surrounding body of water on both sides, the tungsten cylinder diminishes the cancellation of the sound radiated from the two sides of the diaphragm by forcing the sound wave to travel a further distance before cancellation can take place. The choice of tungsten arises from a need to use a material with large density. This approach is however not practical for use in a sound projector adaptable for use by divers because of the large weight required.

Some plastic materials have a speed of sound approaching that of water. Sound waves propagated in water are transmitted through such materials with little or no attenuation and reflection. With the proper choice of material for the retaining cap 4, the sound waves radiate relatively unimpeded through the wall of the retaining cap 4. The presence of the holes 5 in the retaining cap 4 serve to aid in the purging of air from the underwater audible signalling device and as a means of fluid communication for the flow of water required for vibrational excitation of the diaphragm 9.

The inventor has found that the interior size and shape of the retaining cap 4 is important. The water flowing through the oblong opening 12 while sound is produced is discharged into the retaining cap 4 in an discontinuous fashion, producing eddies or vortices. The fluctuating pressure imposed on the reed 10 by the eddies provides the required positive feedback to cause the reed to vibrate with a large amplitude. It has been found that this beneficial process is aided if the internal height of the retaining cap 4 is equal to or larger than the internal radius.

By manually squeezing the water-filled elastic bulb 2, a stream of water is forced through the sound projector 1, which causes the reed 10 to vibrate in a non-sinusoidal motion at a frequency determined largely by resonant frequency. These vibrations are transmitted to the diaphragm 9, which cause it to vibrate. The resonant frequency of the diaphragm 9 is determined by material properties, the type of edge restraint, and the vibrational interaction with a surrounding body of water. The mass of the water set in vibration by the diaphragm 9 causes the vibration frequency to decrease from the value determined in vacuum. This is commonly referred to as the diaphragm water-loading effect. The inventor has found that, in general, good efficiency of the underwater audible sound projector is achieved when a harmonic of the vibration frequency of the reed 10 coincides with the resonant frequency of the diaphragm 9. More specifically, the best efficiency of the underwater audible sound projector is achieved when the third harmonic of the vibration frequency of the reed 10 coincides with the resonant frequency of the diaphragm 9. When this condition is fulfilled, the diaphragm 9 acts as a resonant sounding board, coupling the acoustic vibrations in an efficient manner into the surrounding body of water.

The inventor has found that the dimensions of the reed 10 and the oblong opening 12 are important with respect to the intensity and efficiency of the sound produced by the underwater audible sound projector. To achieve largest sound intensity, the dimensions shall be chosen such that the available hydraulic pressure nearly closes the valve formed by the reed 10 and the diaphragm 9. Generally the available pressure for a manually operated elastic bulb 2 is in the range of 5 to 25 psi. Conventional structural calculations can be used to determine preferable dimensions to suit this criterion. Duration of the sound depends on the aforementioned dimensions and on the size of the elastic bulb 2. The intensity of the sound produced by the underwater audible sound projector stands in relation to the size of the reed 10, the diaphragm 9 and the oblong opening 12, with larger sizes producing a more intense sound.

By way of example, it has been found that an underwater audible sound projector with a diaphragm 9 of 1.500 inch diameter and a thickness of 0.060 inch, and an oblong opening 12 with a width of 0.250 inch and a length of 0.700 inch, when used in conjunction with a reed 10, which measures 0.030 inch thickness by 0.287 inch width by 1.025 inch length and spaced away at the free end of the reed from the diaphragm 9 by a distance of 0.020 inch produces an underwater sound audible over a range of 600 feet.

Experiments show that the dimensions of the flat overlapping area between the reed 10 and the diaphragm 9 are important. The overlapping area, especially close to the free end of the reed 10, must be made as small as practical in order to avoid damping the motion of the reed and the diaphragm 9.

The inventor has found that the underwater audible signalling device works well in ocean, river and lake water, regardless of turbidity caused by plankton and algae. It is also possible to operate the underwater audible signalling device in ocean water that contains fine sand, such as that occurring in sandy shoreline breakwater, provided the water-filled sound projector 1 is encased in a thin elastic rubber membrane. The elastic rubber membrane does not have to encase the elastic bulb 2, which makes it easy to operate the underwater audible signalling device. The underwater audible signalling device then in effect forms a closed water filled unit that is unaffected by fine sand particles. A protective rubber membrane does not reduce the intensity of the sound because of the good match in sound velocity to water.

The choice of certain materials offers advantage in achieving high sound intensity from the underwater audible sound projector and absence of corrosion from exposure to seawater. Preferable material for the diaphragm 9 and the reed 10 is a corrosion resistant steel of type ASI 304L. The diaphragm 9 and reed 10 are to be fully passivated after they have been assembled in order to obtain the necessary corrosion resistance. The diaphragm 9 is preferably made from a material in an annealed temper, and the reed 10 is preferably made from the same type of material with a partial spring temper.

In an alternate embodiment, the diaphragm 9 and the reed 10 can be made from a low damping reinforced plastic, such as a moldable graphite reinforced resin. One end of the reed 10 can be attached to the diaphragm 9 by forming the molding cavity such that the two elements are parts of an unitary body. A moldable thermoplastic resin, such as acetal resin, is preferable for the housing 3 and the retaining cap 4, because of its desirable mechanical and acoustical properties.

Most prior art air horns utilize a valve comprising a stationary nozzle and a vibrating diaphragm. Due to the unstable flow characteristics of the valve, air forced through this valve causes the diaphragm to vibrate, when the air horn is used above water. As mentioned earlier, sound emanating from one side of the diaphragm is prevented from destructively interfering with the sound from the other side, usually by enclosing one side of the diaphragm within a housing. Also as mentioned earlier, prior art air horns emit only a low buzzing sound when operated underwater with a stream of water due to the twin effects of the incompressibility of the water and the inability to confine the sound in the housing that encloses one side of the diaphragm. In an alternate embodiment, the inventor has found that it is possible to adapt prior art diaphragm-based air horns in accordance with the present invention, such that they can be made to work underwater when powered by a stream of water. This is accomplished by incorporation of a compressible body in the housing that encloses one side of the diaphragm. Although such water powered converted air horns are effective underwater, it is not easy to adapt them to the particular requirements imposed by the diving environment.

While preferred embodiments of the present invention are disclosed herein for purposes of explanation, numerous changes, modifications, variations, substitutions and equivalents, in whole or in part, should now be apparent to those skilled in the art to which the invention pertains. Accordingly, it is intended that the invention be limited only by the spirit and scope of the appended claims.

I claim:

1. A device for projecting audible sound waves into a surrounding body of water comprising:

a housing forming a liquid-filled chamber therein; and a diaphragm enclosing said chamber; and means for vibrating said diaphragm; and said vibrations projecting sound waves into said surrounding body of water and into said chamber; and means for containing said sound waves inside said chamber; and means for rendering said liquid in said chamber effectively compressible; and said means for containing sound waves in said chamber and said means for rendering said liquid compressible in said chamber comprise a compressible absorber incorporated in said chamber;

said means for vibrating said diaphragm comprise a valve in communication with said diaphragm; and means to introduce liquid under pressure, into said chamber causing said valve to vibrate; and said valve comprises a reed partially closing an opening in said diaphragm; and means to affix one end of said reed to said diaphragm.

2. A device as defined in claim 1 wherein:

said liquid, under pressure, causes said reed to vibrate at said reeds resonant frequency; and where said diaphragm is caused to vibrate due to said vibrations in said reed.

3. A device as defined in claim 1 wherein:

said means of introducing liquid, under pressure, into said chamber comprise a manually actuated bulb, wherein said elastic bulb is directly attached to said device.

4. A device as defined in claim 1 wherein:

said diaphragm is selected to cause the resonant frequency of said diaphragm to substantially coincide with a harmonic of the resonant frequency of said reed.

5. A device as defined in claim 4 wherein:

said diaphragm is affixed to said housing by means of a retaining cap; and said retaining cap is shaped to form a cylindrical cavity.

6. A device as defined in claim 5 wherein:

said retaining cap is formed to incorporate holes for fluid communication with said surrounding body of water; and said holes are formed to allow purging of air from the interior of said device.

7. A device as defined in claim 6 wherein:

said retaining cap, with said holes, is enclosed in a thin flexible membrane to exclude contaminants in said surrounding body of water.

* * * * *